US006574941B1

(12) United States Patent
Neri

(10) Patent No.: US 6,574,941 B1
(45) Date of Patent: Jun. 10, 2003

(54) METHOD AND MACHINE FOR BANDING GROUPS OF SHEETS

(75) Inventor: Armando Neri, Bologna (IT)

(73) Assignee: Currency Systems International, Irving, TX (US)

( * ) Notice: Subject to any disclaimer, the term of this patent is extended or adjusted under 35 U.S.C. 154(b) by 148 days.

(21) Appl. No.: 09/680,311

(22) Filed: Oct. 6, 2000

(30) Foreign Application Priority Data

Oct. 13, 1999 (IT) ..... BO99A0548

(51) Int. Cl.[7] ..... B65B 13/02; B65B 13/04

(52) U.S. Cl. ..... 53/399; 53/586; 53/588; 53/177; 100/14; 100/27

(58) Field of Search ..... 53/589, 176, 399, 53/586, 587, 588; 100/33 PB, 32, 29, 27, 14

(56) References Cited

U.S. PATENT DOCUMENTS 3,331,312 A * 7/1967 Leslie et al. ..... 100/28
3,470,814 A * 10/1969 Tschappu ..... 100/14
3,665,845 A * 5/1972 Lyon ..... 100/27
4,117,650 A * 10/1978 Ito et al. ..... 100/27
4,691,498 A * 9/1987 Stamm ..... 100/32
6,041,581 A * 3/2000 Huber ..... 100/26
6,178,720 B1 * 1/2001 Schianchi ..... 53/399

* cited by examiner

*Primary Examiner*—Rinaldi I. Rada
*Assistant Examiner*—Hermant M Desai
(74) *Attorney, Agent, or Firm*—Colin P. Cahoon; Carstens, Yee & Cahoon, LLP

(57) ABSTRACT

The invention relates to a method and machine for banding groups of bank notes in which a web is projected towards a banding station by a pair of motor-driven rollers, until the end of the web reaches a gripper unit which is mobile, driven by a support and drive device, which draws the web along a closed path defined by a plurality of guide pins until it reaches a final position which coincides with the starting position; upon completion of the feed stage the guide pins move to a position in which they are no longer in contact with the web, which is recovered by the rollers so that the web forms a loop around the group; a cutting device and a sealing device complete the banding stage by cutting and securing a band around the group.

26 Claims, 10 Drawing Sheets

1
17
55
5
P3
55
17
18
27
18
22
15
16
21
8
20
53
2
3
17
18
18
17
41
43
55
27
55
13
40
29
45
6
42
25
T1
28
44
24
35
10
5
23
38
D1
64
9
4
P1
11a
14
30
12
10a
11
17
75
37

1
18
55
22
55
18
17
17
16
53
2
58
15
3
17
58
58
17
18
27
55
25
24
T1
23
10a
10
42
9
5
D2
64
P1
4
14
11
11a
74
75
9a
12
61
63

METHOD AND MACHINE FOR BANDING GROUPS OF SHEETS

BACKGROUND OF THE INVENTION

The present invention relates to a method for banding groups of sheets, in particular bank notes.

The present invention is advantageously applied on machines which arrange bank notes into groups then transfer them to a banding machine which applies at least one band to each group of bank notes, thus securing them in position.

As is known, the institutes which issue bank notes, also known as the central banks, and commercial banks have to handle large quantities of paper money every day. For this purpose, the bank notes are first divided into groups, then placed in bags or boxes for transportation.

To hold such groups together and transport them without the risk of the notes separating and also in order to prevent tampering, bands are applied to them, securing them in position and preventing theft from them.

For this purpose, bank notes are loaded into the above-mentioned machines in succession and, once checked and divided according to their value and/or type, are sent on to the various group formation channel outfeeds.

A stack of individual bank notes forms at each of these outfeeds and, when a given number is reached, defining one of the above-mentioned groups, they are picked up and transferred to a banding station, where a band is applied to each group.

For the above reasons, banding must be rapid, precise and must provide a strong, high quality finished product. Particularly in the case of the central banks, freshly printed bank notes must be handled with extreme care, to prevent accidental damage which could compromise their issue.

Bands are applied to the groups of bank notes by known machines, comprising a unit which projects and feeds a continuous web, unwound from a reel, and a circular channel along which the web is fed, pushed by the projecting unit, until it forms a loop along a looped path within which a group of bank notes is fed.

Then, rollers which are part of the projecting unit recover one end of the web previously fed, reducing the size of the loop until the web is brought into contact with the group and binds it with a preset tension.

Following this web positioning operation, a cutting and sealing unit cuts the web and seals the two separate ends of the web, forming a retaining band.

Obviously this operation may be repeated according to the number of bands to be applied to each group of bank notes.

One of the disadvantages of the aforementioned type of machines is that during both the projecting and the push-feed stages, the end of the web, which is out of control and not picked up, is free to assume incorrect positions relative to the circular channel and so may cause jamming or the web may exit the channel.

This disadvantage is most noticeable when the reel is about to finish and its diameter is smaller. During this stage, the profile of the web tends to be more curved than normal and it is more likely that it will assume incorrect positions during the stage in which it is projected towards the infeed of the feed channel.

Moreover, the two separate ends of the web may be incorrectly positioned following the cutting operation. Therefore, for the reasons indicated above, such machines have limited operating speed, are imprecise and are not completely reliable.

SUMMARY OF THE INVENTION

The aim of the present invention is to provide a method for banding groups of sheets, in particular bank notes, which can apply bands in a rapid, precise manner and guarantees a strong, high quality end result.

Accordingly, the present invention provides a method for banding groups of sheets in a substantially parallelepiped configuration, the method comprising stages for arranging a group of sheets at a station for the application of at least one retaining band on the group of sheets; using first gripper means to grip the end of a continues web, unwound from a reel and fed in a first direction along a first feed path; drawing the web using the first gripper means, from a starting position adjacent to the banding station, in such a way that it is drawn along a second, closed path, inside which the banding station lies, and returning the end of the web to the starting position, where the end of the web is positioned opposite a section of web extending in an outfeed section of the first feed path; recovering the web using second gripper means, located upstream of the outfeed section of the first feed path, which grip the web and draw it in a second direction which is opposite to the first, so that the web adheres around the group of sheets with a preset tension; sealing the end of the web, at the above-mentioned starting position, to a portion of the section of the web at the outfeed section of the first feed path; cutting the web upstream of the sealing zone relative to the first direction of feed.

The present invention also relates to a machine for banding groups of sheets.

Another aim of the present invention is to provide a machine for banding groups of sheets, which implements the method provided in accordance with the present invention.

Accordingly, the present invention provides a machine for banding groups of sheets in a substantially parallelepiped configuration, the machine comprising a station for applying at least one retaining band to the group of sheets, where pick up and transfer means position a group of sheets; first gripper means which grip the end of a continuous web unwound from a reel and move it in a first direction along a first feed path, the first gripper means being mobile so that they can draw the web from a starting position adjacent to the banding station, along a second, closed feed path inside which the banding station is located, then return the end of the web to the starting position, where it is opposite a section of web extending in an outfeed section of the first feed path; second gripper means, located upstream of the outfeed section of the first feed path, which recover the web, drawing it in a second direction which is opposite to the first, so that the web adheres around the group of sheets with a given tension; sealing means located at the starting position adjacent to the banding station and mobile between a non-operating position and an operating position, in which they seal a portion of the section of web extending along the outfeed section of the first feed path to the end of the web; cutting means for cutting the web upstream of the sealing zone relative to the first direction of web feed.

BRIEF DESCRIPTION OF THE DRAWINGS

The invention will now be described with reference to the accompanying drawings, which illustrate a preferred embodiment of the invention without limiting the scope of its application, and in which.

DESCRIPTION OF THE PREFERRED EMBODIMENTS

Figure 1:
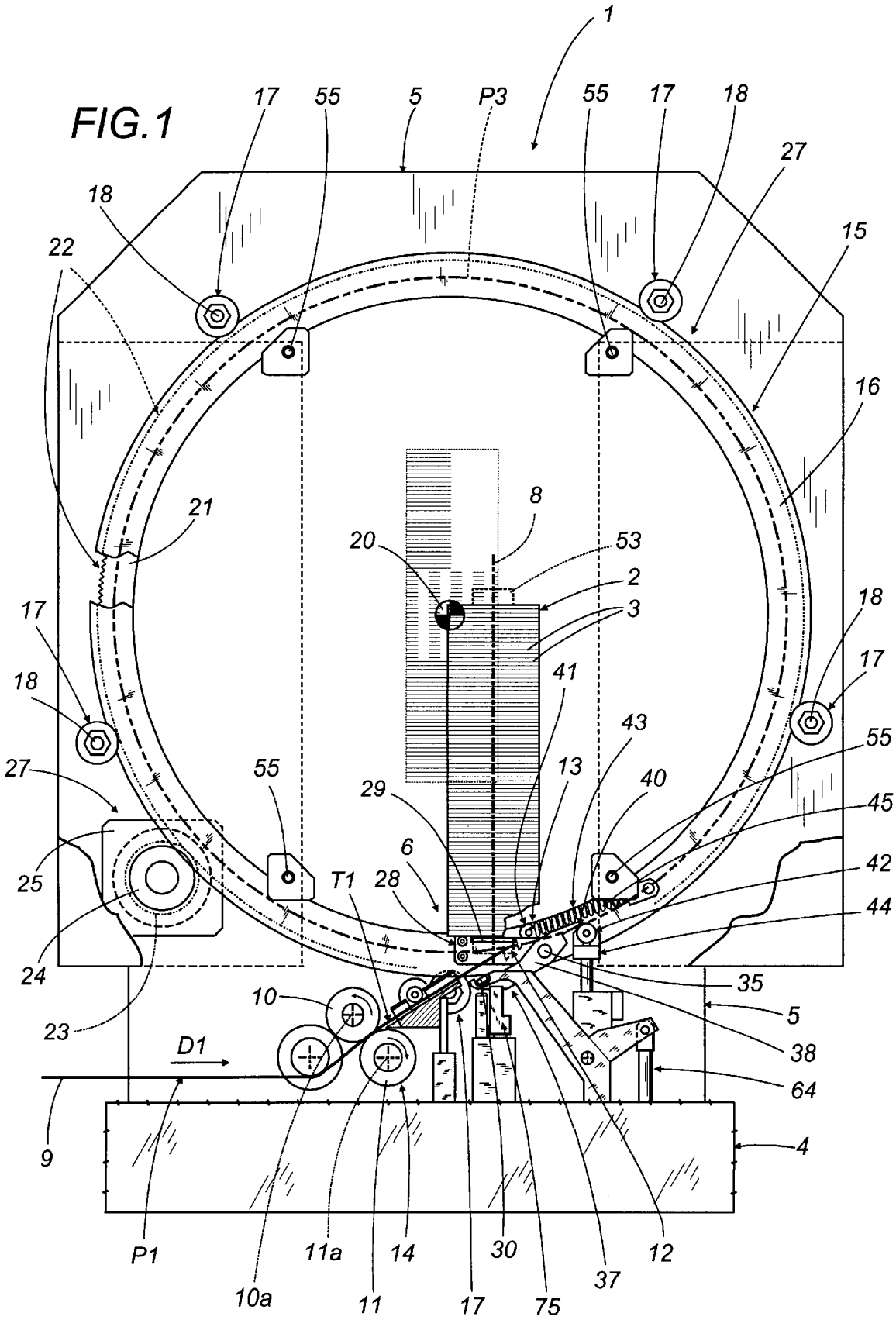
FIG. 1 is a schematic front view, with some parts cut away for the purpose of clarity, of a preferred embodiment of a machine made in accordance with the present invention.

With reference to FIGS. 1, 4, 5, 8, 9, 10 and 11, the numeral 1 indicates as a whole a machine for banding groups 2 of sheets which, in this particular case, are bank notes 3.

The machine 1 comprises a base 4 which supports a vertical wall 5 which supports a station 6 for applying at least one retaining band 7 around a group 2 of bank notes 3 stacked along a vertical stacking axis 8 in such a way that, once formed, the group 2 has a substantially parallelepiped configuration.

Each band 7 is obtained from a continuous web 9 of a wrapping material unwound from a reel (not illustrated) and fed along a first feed path P1 in a first direction D1 towards the above-mentioned station 6 by a pair of rollers 10 and 11, which operate together. At least one of the rollers, more specifically the roller 11, is driven by motor means of the known type, not illustrated.

The rollers 10 and 11 rotate about their axes 10*a* and 11*a*, which are on opposite sides of the first path P1, so that they grip the web 9 and feed the end 12 of the web close to the station 6, where the first gripper means 13 grip the end 12 of the web 9.

The rollers 10 and 11 constitute second web 9 gripper means, labeled 14 as a whole and located upstream of an outfeed section T1 of the web 9 first feed path P1 relative to the first direction D1.

As illustrated in FIGS. 1, 4, 5, 8, 9, 10 and 11, the wall 5 supports a device 15 which supports and drives the first gripper means 13, the device 15 comprising a ring-shaped element 16 supported, on the plane on which it lies parallel with the wall 5, by a plurality of grooved idle rollers 17 supported by shafts 18 whose axes are perpendicular to the wall 5.

As illustrated in FIGS. 8, 9, 10 and 11, each grooved roller 17 has a ring-shaped race 19 cut into it, in which the ring-shaped element 16 is housed and slides freely, rotating about its axis 20 which is perpendicular to the wall 5.

The ring-shaped element 16 is integral with a ring gear 21 whose internal diameter is equal to the internal diameter of the ring-shaped element 16 and which has external toothing 22 that engages with a pinion 23 keyed to the end of an output shaft 24 of a motor 25 whose axis 26 is parallel with the axis 20 of rotation of the ring-shaped element 16.

The ring-shaped element 16, ring gear 21, pinion 23 and motor 25 therefore constitute means which drive the above-mentioned first gripper means 13, labeled 27 as a whole.

As illustrated in FIGS. 1, 2, 3, 4 and 13 the first gripper means 13 comprise a gripper unit 28 which comprises a first and a second jaw 29, 30 positioned opposite one another. The first jaw 29 comprises a bracket 31 fixed to the outer wall 32 of the ring-shaped element 16 and having a contact surface 33 supported by the bracket 31 in a position perpendicular to the wall 32.

The surface 33 has a first face 34 facing the second jaw 30 and defining a contact wall for the second jaw 30, which pivots about a pin 35 which is also supported by the bracket 31 and has an axis 36 parallel with the surface 33 and about which the second jaw 30 oscillates, mobile relative to the fixed first jaw 29.

The second jaw 30 comprises a first class lever 37 with three arms, the end 39 of the first arm 38 constituting the second jaw 30. A second arm 40 is located on the extension of the first and on the opposite side of the pin 35. The third arm 41, as can be seen in FIG. 13, lies on a different plane to that of the first and second arms 38, 40 and is positioned crossways to the second arm 40.

Figure 2:
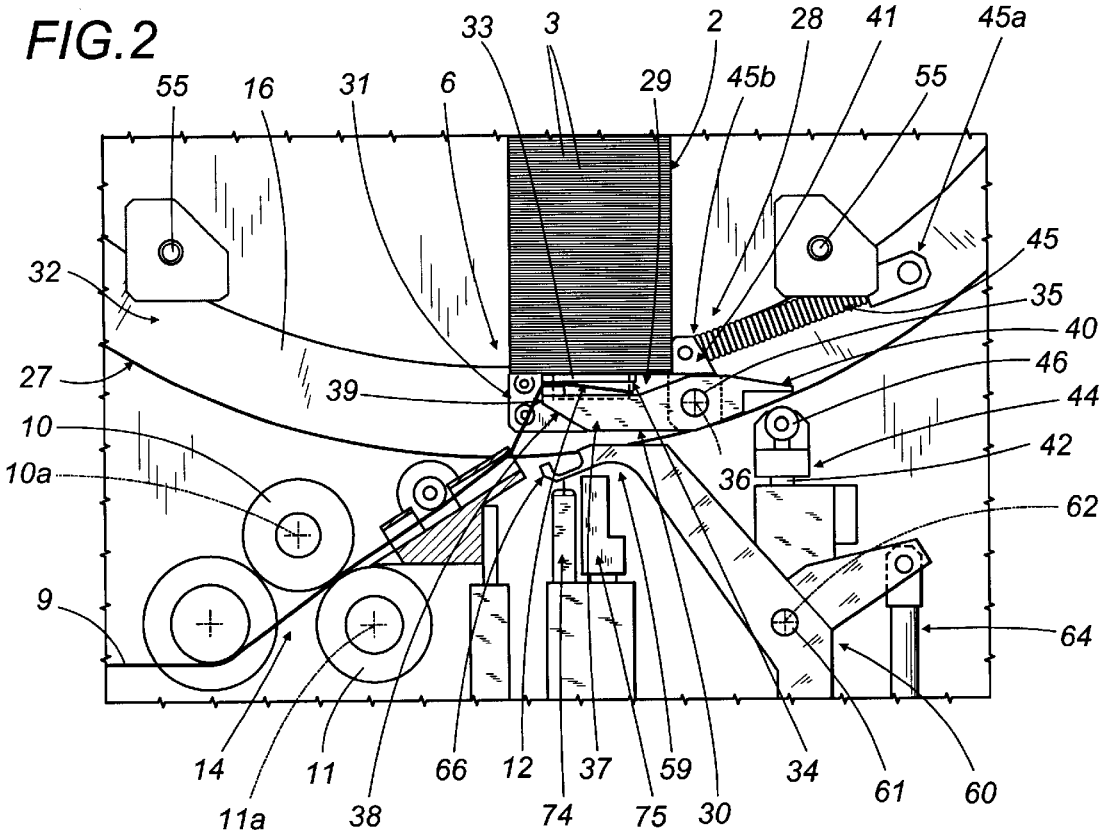
FIGS. 2 and 3 are respectively schematic front views of the details in FIG. 1 in a succession of operating stages for gripping and drawing the web.
Figure 13:
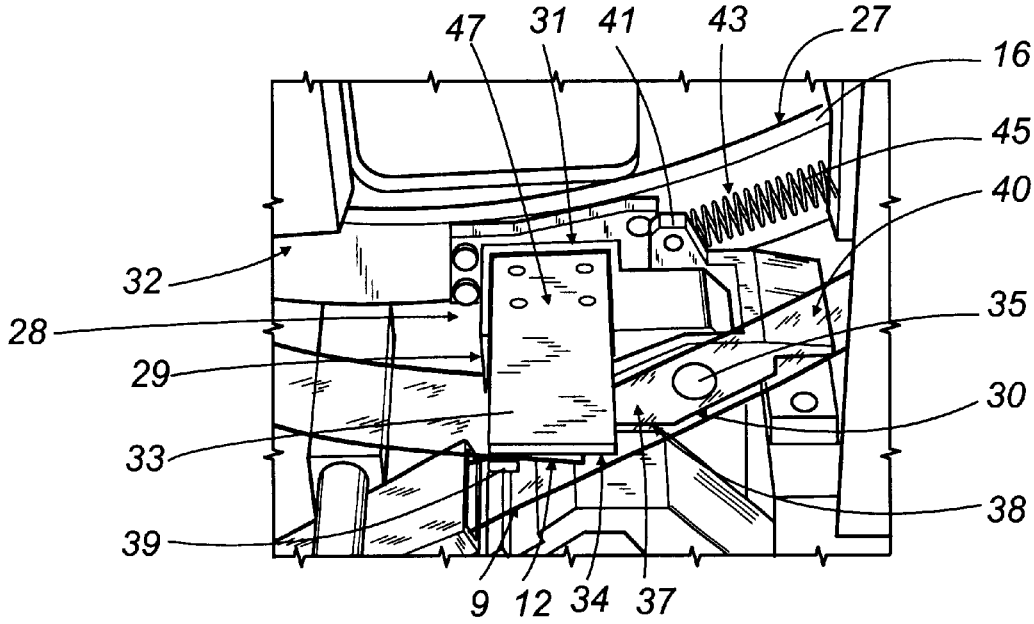
FIG. 13 is a schematic perspective view from above of a detail in FIG. 1.

The second jaw 30 oscillates between a first, non-operating position in which it is open, illustrated in FIG. 1, in which the end 39 of the first arm 38 is distanced from the contact surface 33 and the gripper unit 28 is in the position in which it waits for the end 12 of the web 9 fed along the outfeed section T1 of the first feed path P1 until it reaches a position in which it can be gripped, and a closed operating position, illustrated in FIGS. 2 and 13, in which the end 39 of the first arm 38 grips the end 12 of the web 9 and brings it into contact with the first face 34 of the surface 33.

The oscillation of the second jaw 30 about the pivot pin 35 is obtained using first and second actuator means 42, 43 which co-operate and which comprise a linear cylinder 44 supported by the base 4 and, respectively, a helical spring 45 one end 45*a* of which is fixed to the ring-shaped element 16, whilst the other end 45*b* is fixed to the third arm 41 of the lever 37.

In particular, the end of the cylinder 44 is fitted with a roller 46 which moves between a raised and a lowered position.

In the raised position, illustrated in FIG. 1, the roller 46 intercepts the second arm 40 of the lever 37, causing the latter to perform a first rotation, anti-clockwise in FIG. 1, towards its open position against the elastic resistance of the spring 45, which stretches when subjected to traction by the third arm 41. As is more clearly illustrated in FIG. 13, the latter, being integral with the second arm 40, also performs a first, anti-clockwise rotation equal to that of the second arm 40.

In the lowered position, illustrated in FIG. 2, the roller 46 releases the second arm 40 and the spring 45 returns to its home position, causing the third arm 41 to perform a second rotation, equal to and in the opposite direction to the first, clockwise in FIG. 2, corresponding with a clockwise rotation of the first arm 38 as far as a position in which the end 39 makes contact with the first face 34 of the surface 33, against which it grips the end 12 of the web 9. The first arm 38 is held in this position by the spring 45 which is integral with the gripper unit 28.

As illustrated in FIGS. 8, 9, 10 and 11, the second, upper face 47 of the surface 33, opposite the first, lower face 34, constitutes a reference element for the groups 2 of bank notes 3, each of which is picked up at a forming station, of the known type and not illustrated, by pick up and transfer means 48.

The pick up and transfer means 48 comprise a clamp 49 supported by a support part 50 in the form of a column which extends along an axis 51 parallel with the bank note 3 stacking axis 8 and is supported by an arm 52 which is part of the drive means, of the known type and not illustrated, which can move the part 50 along any path and in any direction from the forming station to the station 6 in which the bands 7 are applied and vice versa.

Figure 12:
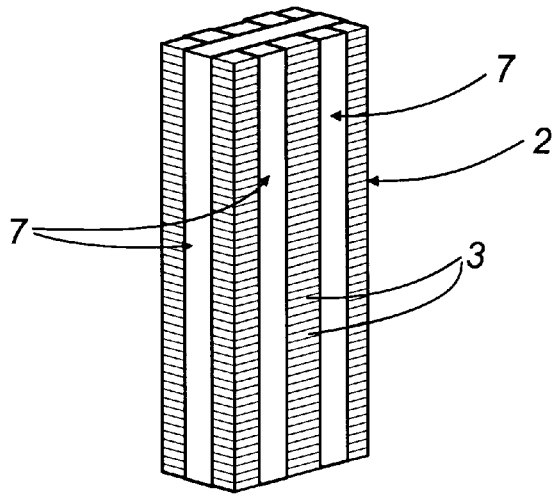
FIG. 12 is a schematic perspective view of a group of sheets to which bands have been applied.

The clamp 49 has two pick up jaws 53, one upper and one lower, which allow the clamp 49 to grip and clasp the groups 2 of bank notes 3 and whose movement towards and away from one another occurs along the axis 51 along which the support part 50 extends. The two jaws 53 also rotate about respective axes 54 parallel with the axis 51, so that they can turn the group 2 of bank notes about its stacking axis 8 and allow the application of a plurality of bands 7 about the group 2 at different application zones, as illustrated in FIG. 12.

As illustrated in FIGS. 2, 3, 4 and 8, the gripper unit 28 can rotate about the axis of rotation 20 of the ring-shaped element 16 so as to draw the web 9 along a second, closed path P2 from a starting position which is adjacent to the banding station 6, illustrated in FIG. 2. In this position the second jaw 30 has gripped the end 12 of the web 9 and clasps it against the first face 34 of the surface 33 of the first jaw 29, until the end 12 of the web 9 is returned to the above-mentioned starting position, illustrated in FIG. 4, after travelling, integral with the ring-shaped element 16 and fed by the support and drive device 15, along a third, closed feed path P3 which is substantially circular and along which the element 16 extends.

Figure 4:
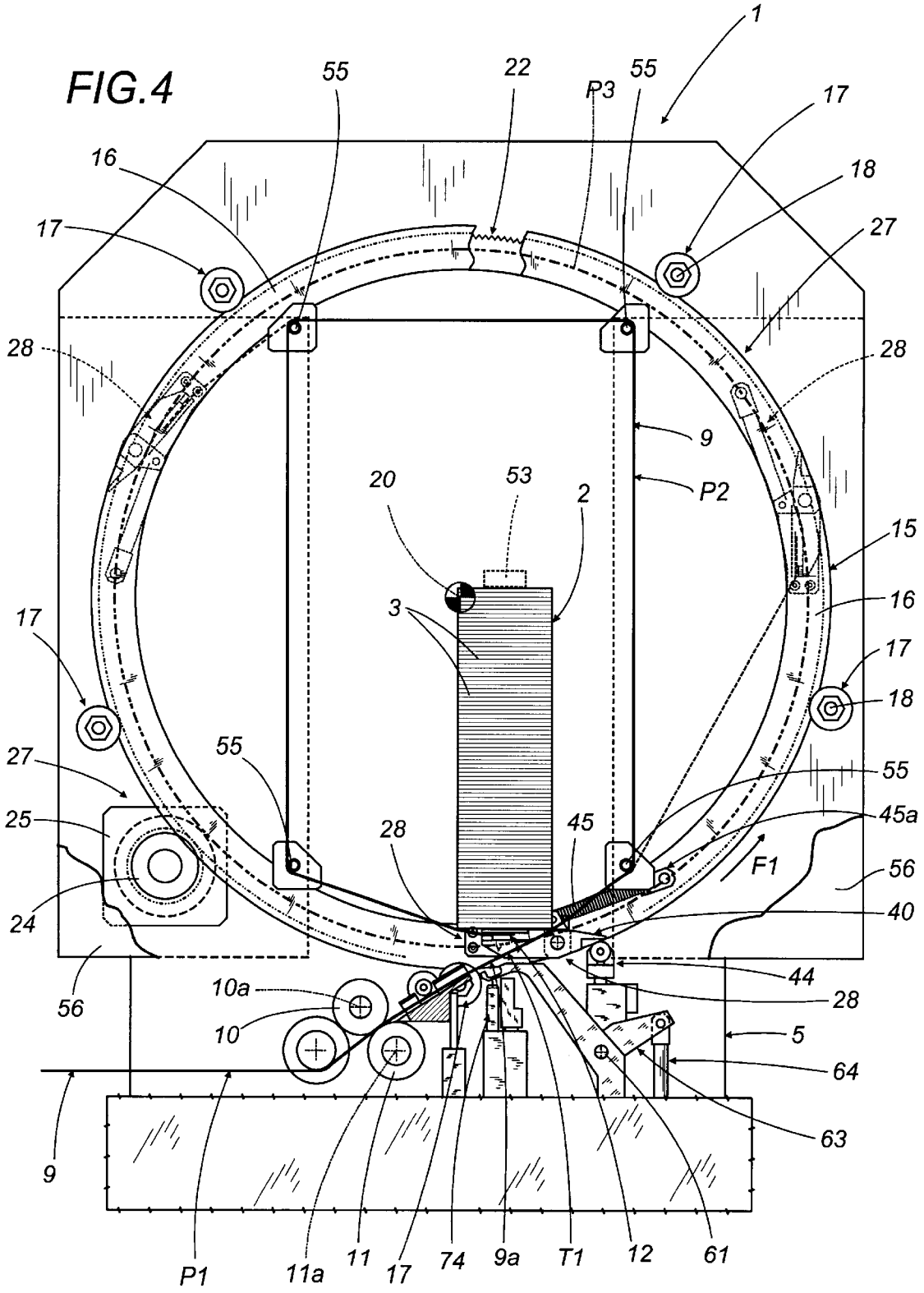
FIGS. 4 and 5 respectively illustrate the embodiment of the machine in FIG. 1 in a further succession of operating stages.
Figure 6:
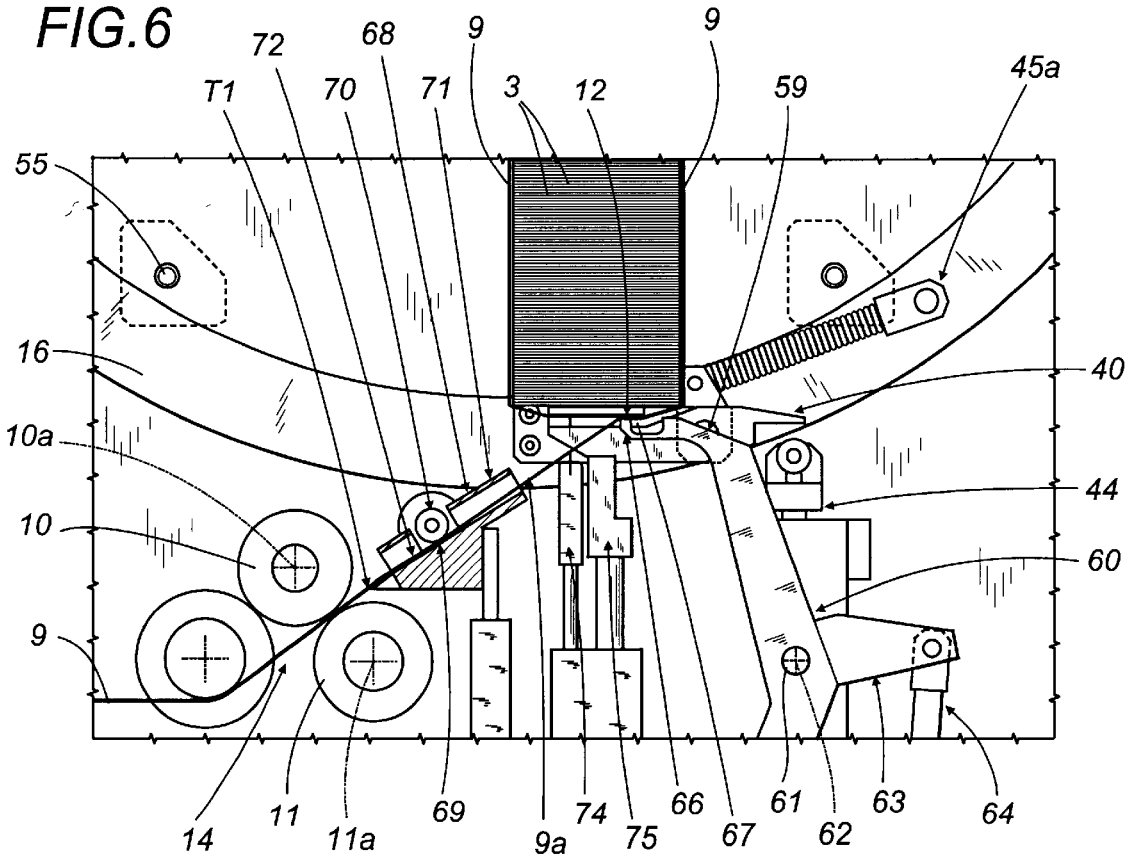
FIGS. 6 and 7 are respectively front schematic views of the details in FIGS. 2 and 3 in a further succession of operating stages.

As illustrated in FIGS. 4 and 6, once the end 12 of the web 9 has been brought back to the starting position, after completing the second path P2, the end 12 is opposite a section 9a of the web 9 which extends along the outfeed section T1 of the web 9 first feed path P1.

Figure 8:
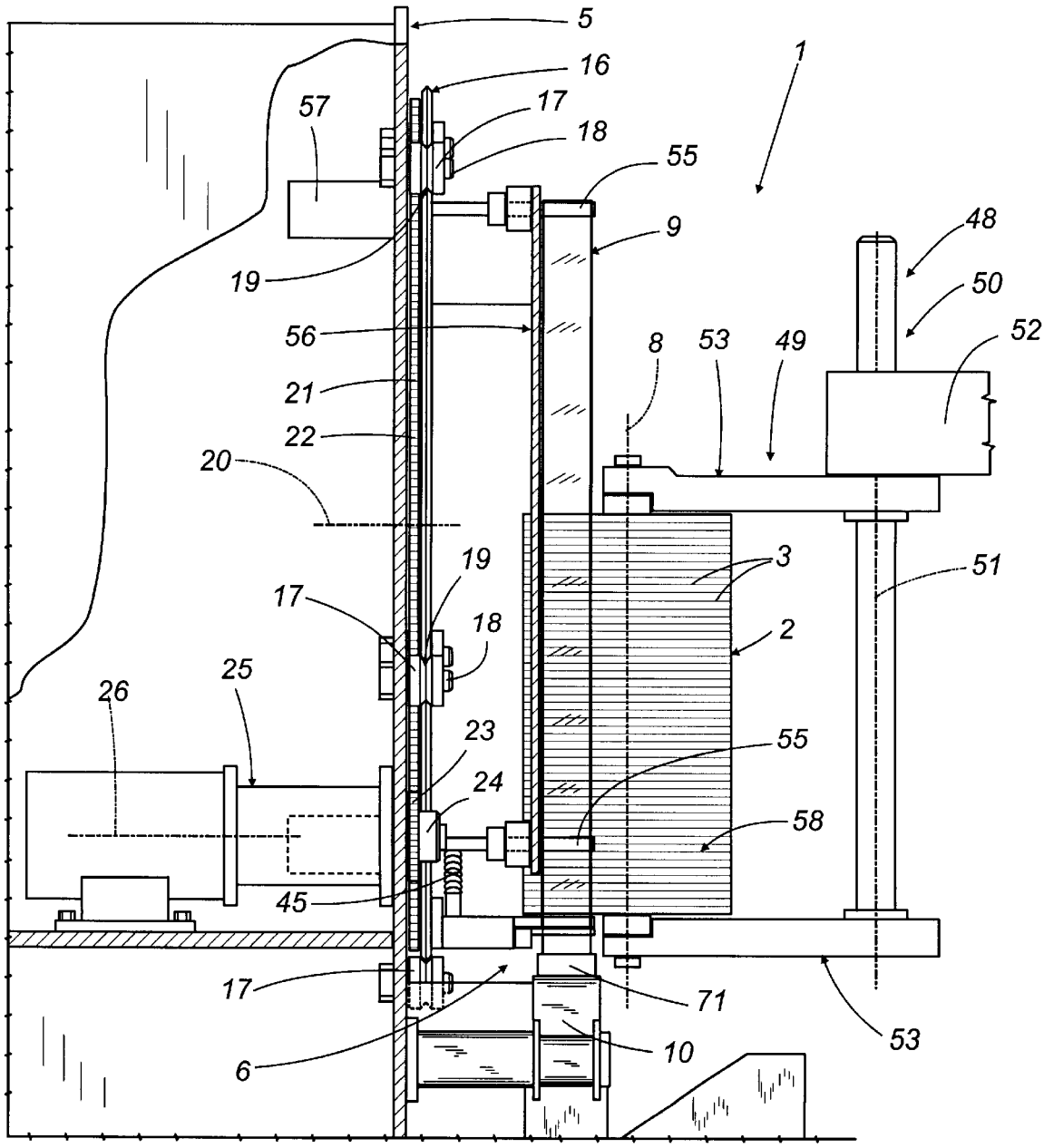
FIG. 8 is a schematic side view, with some parts cut away for the purpose of clarity, of the machine in FIG. 1 in the operating stage illustrated in FIG. 4.

As illustrated in FIGS. 4 and 8, the third path P3 contains the second, closed path P2 along which the web 9 is arranged and defined by four guide pins 55 whose axes are parallel with one another and which are perpendicular to the wall 5. The pins 55 are supported by a pair of walls 56 parallel with the wall 5 and located on opposite sides of the banding station 6.

Figure 5:
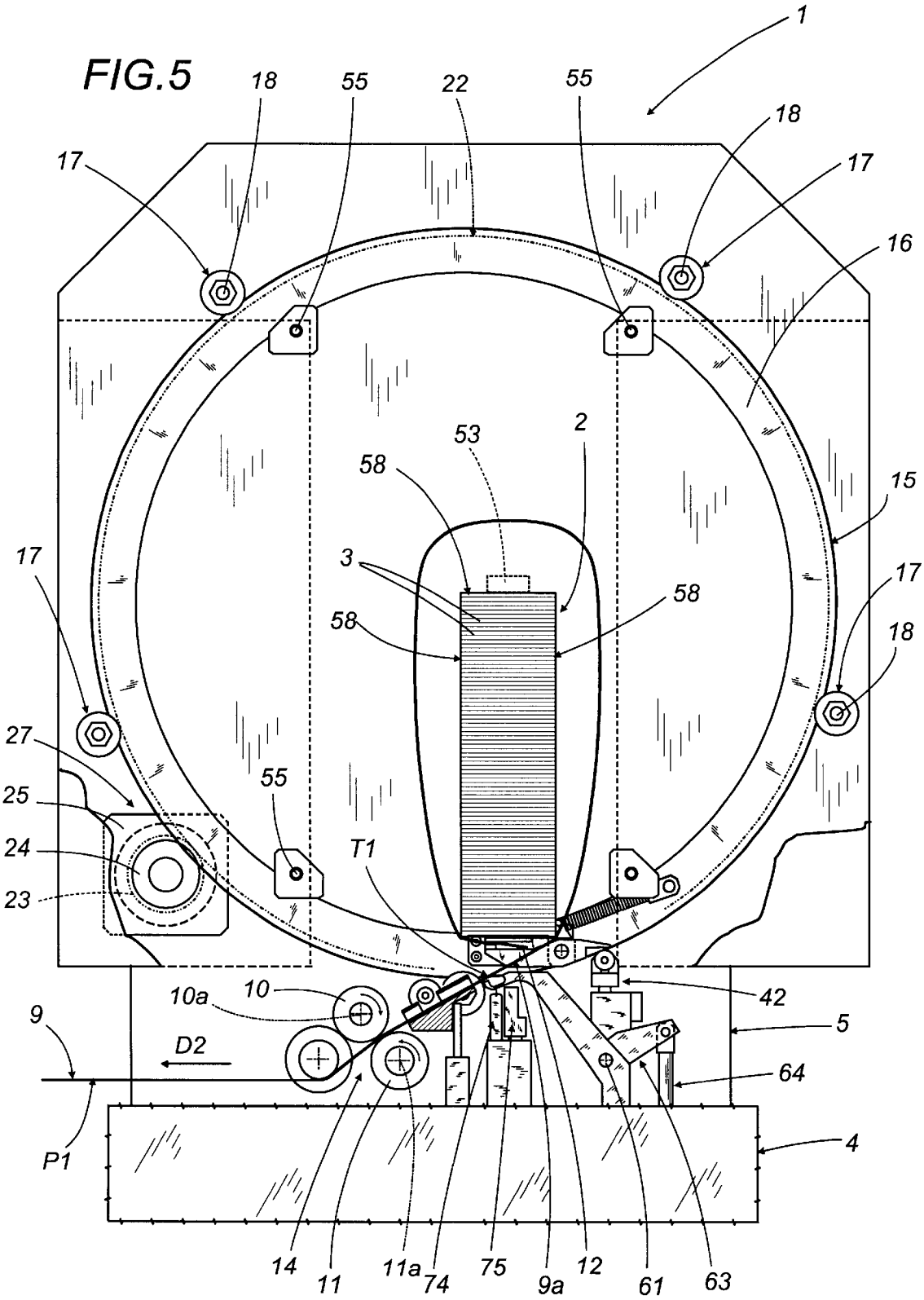
Figure 9:
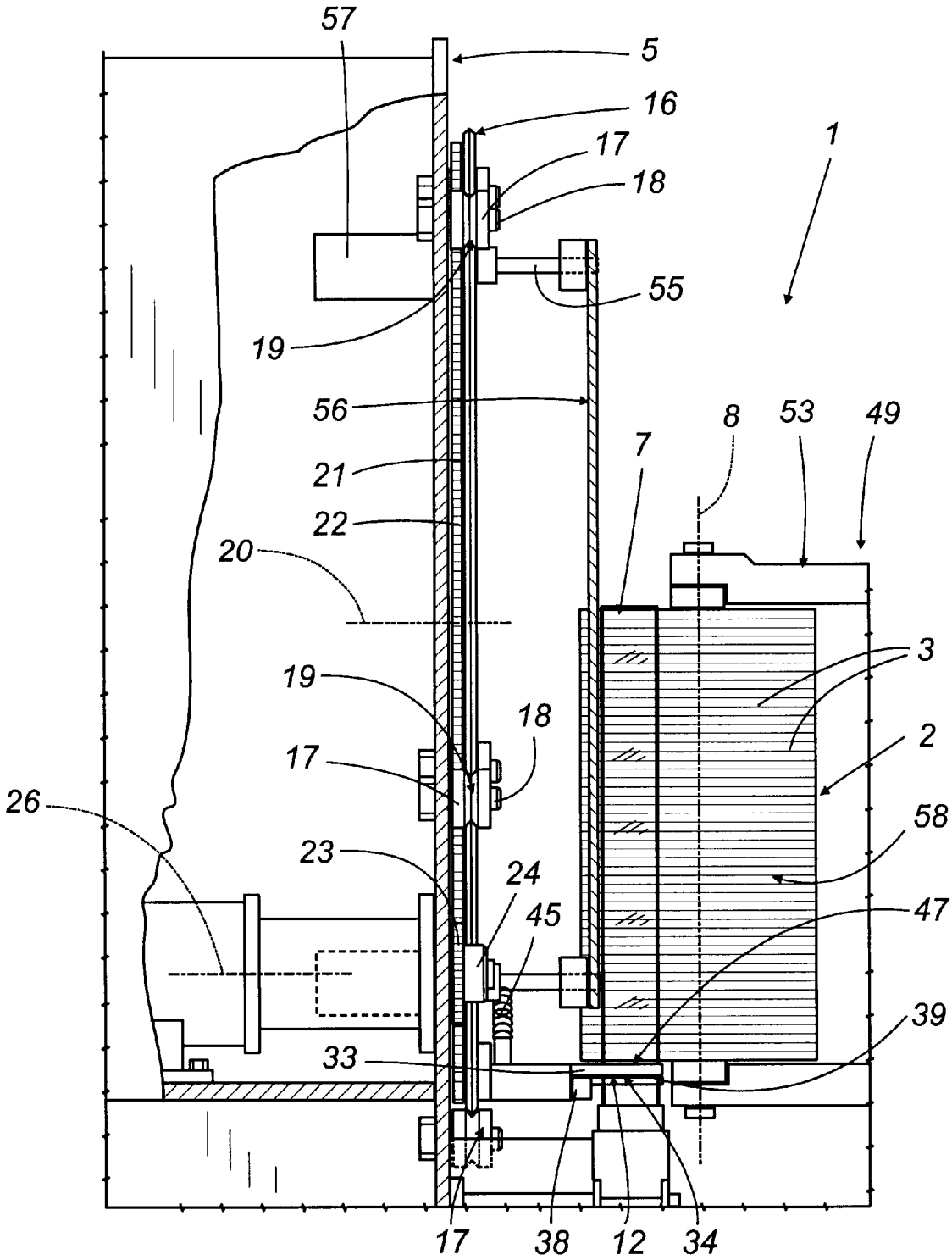
FIGS. 9 to 11 are respectively schematic side views, with some parts cut away for the purpose of clarity, of the machine in FIG. 1 in a succession of operating stages.

As illustrated in FIGS. 4, 5, 8 and 9, each pin 55 has an actuator 57 supported by the wall 5 and designed to move the pin 55 between an operating end position, illustrated in FIGS. 4 and 8, in which each pin 55 exits the wall 56, moving away from the actuator 57, and forms a support for the web 9, modifying its direction and defining the path P2, and a home end position, illustrated in FIGS. 5 and 9, in which each pin 55 has moved towards its actuator 57 and is no longer in contact with the web 9.

As illustrated in FIGS. 1 and 5, the roller 11 of the second gripper means 14 is motor-driven, with the possibility of inverting the motor direction of rotation, so that it can rotate about its axis 11*a* in both directions. In particular, the roller 11 first rotates in a clockwise direction, as illustrated in FIG. 1 and, co-operating with the other roller 10, to allow the web 9 to be projected along the outfeed section T1 of the first path P1. Then, following completion of the stage in which the web is drawn along the second, closed path P2 by the gripper unit 28, and when the guide pins 55 are no longer in contact with the web 9, the roller rotates anti-clockwise, as illustrated in FIG. 5, so as to recover the web 9, drawing it in a second direction D2 which is opposite to the first direction D1, so that the web 9 adheres to the group 2 of bank notes 3 with a given tension, as shown in FIG. 9.

In particular, in practice, as illustrated in FIG. 5, the stage in which the web 9 is recovered by the roller s 10 and 11 envisages that the end 12 of the web is held by the gripper unit 28 and the web 9 is drawn in such a way that it forms a loop around the group 2 of bank notes, so that the web 9 makes contact with the sides 58 of the group 2 to be bound substantially simultaneously.

At the station 6 for application of the band 7, the machine 1 also comprises first retaining means 59, comprising a two-armed lever 60 which pivots on a second oscillating pin 61, supported by the base 4 and whose axis 62 is parallel with the axis 36 of the pivot pin 35 of the second jaw 30.

Figure 7:
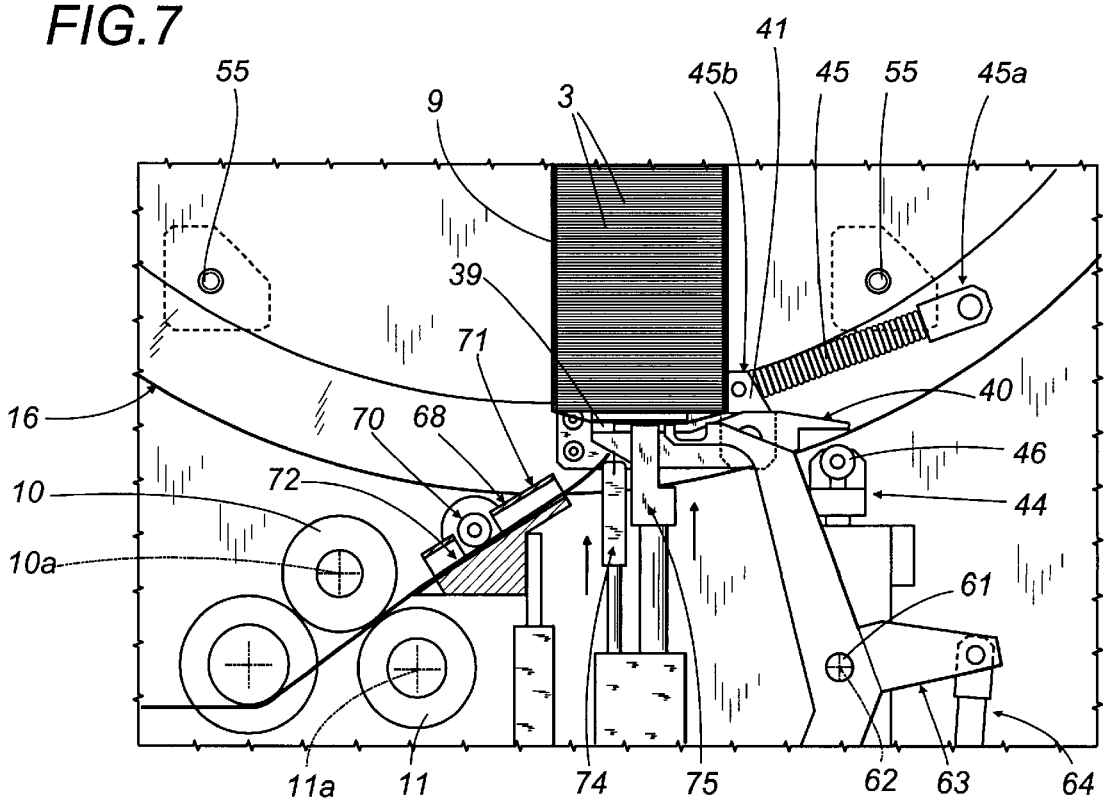

A first arm 63 of the lever is connected to actuator means 64 of the known type, and a second arm 65 is mobile, driven by the actuator means 64, between a first, non-operating position, illustrated in FIGS. 1, 2, 3, 4 and 5, in which it is distanced from the first jaw 29 and its end 66 is on the opposite side of the section 9*a* of web 9 extending along the outfeed section T1 of the first path P1 and is opposite the end 12 of the web 9 held in its starting position against the first face 34 of the surface 33 by the second jaw 30, and a second, operating position, illustrated in FIGS. 6 and 7, in which the free end 66 intercepts a first portion 67 of the section 9*a* of web 9 (also illustrated in FIG. 3) and overlaps it, locking it against the end 12 of the web 9, in contact with the first face 34 of the surface 33 of the first jaw 29.

As illustrated in FIGS. 6 and 7, between the rollers 10 and 11 and the station 6 for application of the bands 7, the machine 1 also comprises second retaining means 68, designed to grip a third portion 69 of the section 9*a* of web 9 against a fixed surface, located on the opposite side of the web 9 to the means 68 and consisting of a fixed roller 70 made of a strong material.

In particular, the retaining means 68 comprise a sliding guide 71 for the web 9 which exits the rollers 10 and 11, comprising a lower surface 72 which co-operates with the roller 70 to lock the web 9. The guide 71 is mobile, driven by the actuator means 73 integral with it, between a position in which it is not in contact with the web 9, illustrated in FIGS. 2 and 3, and a position in which it grips the third portion 69 of the web 9 against the roller 70.

As illustrated in particular in FIGS. 2, 3, 6 and 7, downstream of the guide 71, relative to the web 9 first direction of feed D1 along the first path P1, and at the starting position along the web 9 end 12 gripper unit 28 third path P3, there are, in order, from upstream to downstream in the direction of feed D1, a cutting device 74 and a sealing device 75.

Both the cutting device and the sealing device 74 and 75 are mobile, driven by actuator means of the known type and labeled 76 as a whole, between a non-operating position, illustrated in particular in FIGS. 2 and 3, in which they are below the web 9 first path P1, and a raised operating position, illustrated in particular in FIG. 7, in which the cutting device 74 cuts the web 9 and in rapid succession the sealing device 75 seals the end 12 of the web held between the first and second jaws 29, 30 of the gripper unit 28 to the end of the section of web 9 created by said cutting stage carried out by the cutting device 74.

With reference in particular to FIG. 7, it should be noticed that during the stage which precedes the cutting and sealing operations, the section 9*a* of web 9 is locked and held taut between the end 66 of the lever 60 in contact with the lower face 34 of the surface 33 and the lower surface 72 of the guide 71 in contact with the roller 70. This solution allows a perfect cutting operation and means that the web 9 can be kept wound around the group 2 of bank notes 3 without slackening.

In practice, the pick up and transfer means 48 pick up a group 2 of bank notes from the forming station, gripping them between the two jaws 53, then position each group 2 at the station 6 for application of a band 7, resting on the upper face 47 of the surface 33.

At the same time, the rollers 10 and 11 execute the stage in which they project the end 12 of the web 9 along the first path P1 and in direction D1, until the end 12 reaches the first gripper means 13. As soon as the end 12 of the web reaches said position, the cylinder 44 moves the roller 46 downwards, releasing the second arm 40 of the lever 37 so that, as a result of the traction applied to the third arm 41 by the spring 45, the arm 38 makes contact with the lower face 34 of the surface 33, gripping the end 12 of the web 9.

Figure 3:
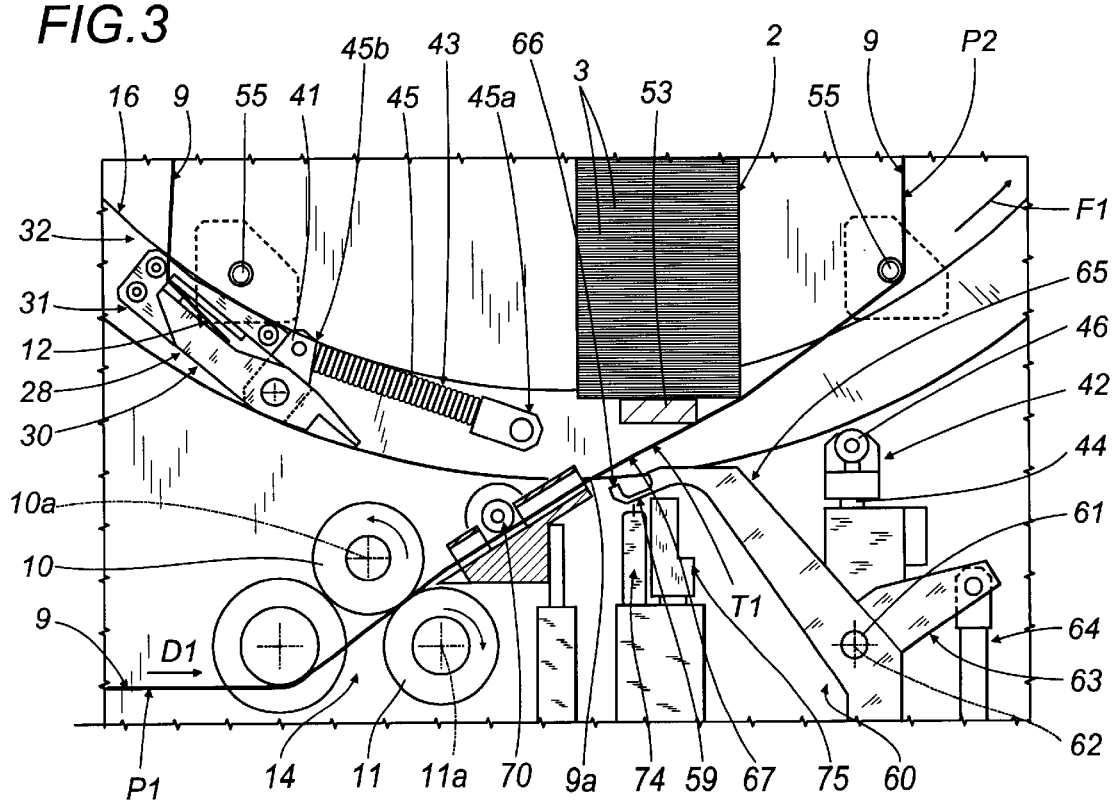

At this point, the pinion 23 of the motor 25 engages with the external toothing 22 of the ring gear 21 and causes the ring-shaped element 16 to rotate anti-clockwise, as illustrated by the arrow F1 in FIGS. 3 and 4, which causes the gripper unit 28 integral with it to rotate about the axis of rotation 20 and along the third path P3, from the starting position. As a result, the web 9 is drawn along the second path P2 defined by the guide means 55 which are in the operating position, resting against the web 9. Having completed the third path P3, the gripper unit 28 returns to the starting position and the guide means 55 are, simultaneously and in a synchronized fashion, moved by the actuator means 57 to the position in which they no longer make contact with the web 9. As a result, the web 9, held in the starting position by the first gripper means 13, is drawn in the second direction D2 by the rollers 10 and 11, so as to allow the web 9 to be wound around the sides 58 of the group 2 of bank notes in a loop.

The subsequent cutting and sealing operations which complete the application of the band 7 do not require any further explanation, since they are described in detail above.

Figure 10:
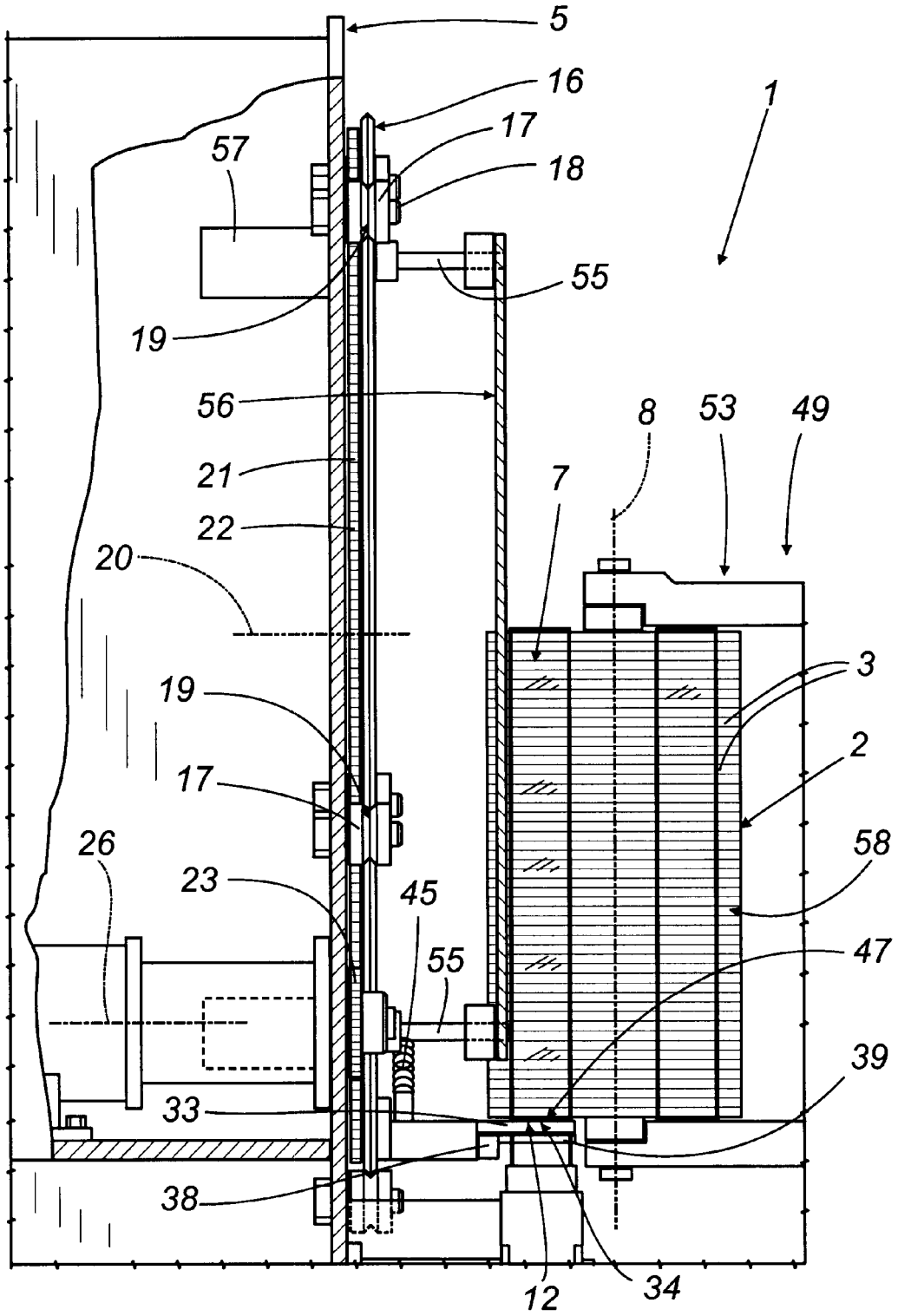
Figure 11:
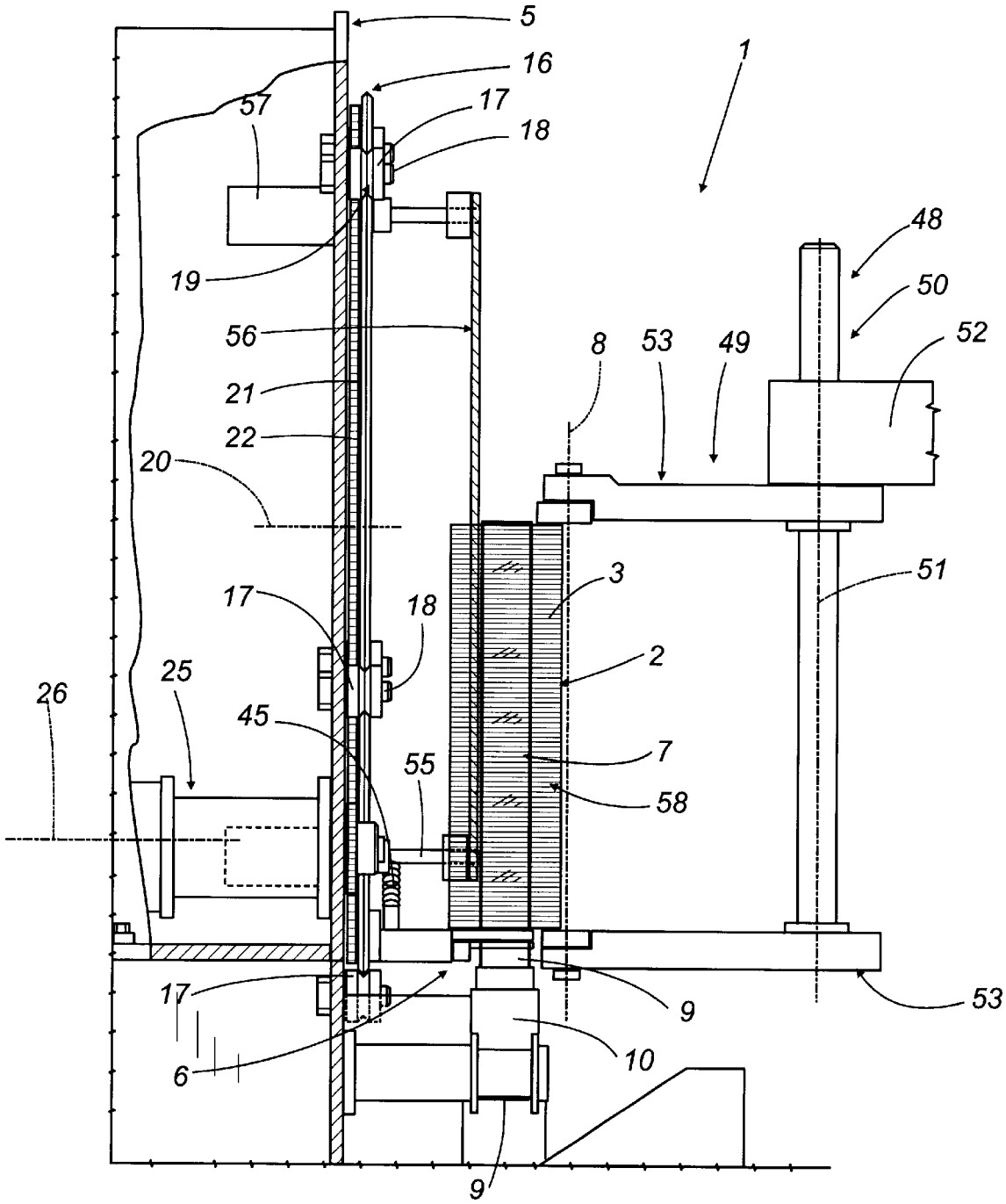

As illustrated in FIGS. 9 to 12, the stage for banding the group 2 of bank notes 3 may envisage the application of two or more bands 7. In particular, according to the embodiment illustrated from FIG. 9, a first band 7 may be applied around an end portion of the group 2 and, as described above, the pick up and transfer means 48 can turn the group 2 about its stacking axis 8 first through 180° so as to allow the application of a second band 7 at the opposite end of the group 2, as illustrated in FIG. 10. Then, as illustrated in FIG. 11, the group 2 can be turned a second time, this time through 90° so as to position it in such a way as to allow application of a third band 7, transversal to the other two bands 7 previously applied, thus obtaining a finished product as illustrated in FIG. 12.

What is claimed is:

1. A method for banding groups of sheets in a substantially parallelepiped configuration, comprising stages for arranging a group of sheets at a station for the application of at least one band which binds the group of sheets; using first gripper means to grip the end of a continuous web, the latter being unwound from a reel and fed in a first direction and along a first feed path; using the first gripper means to draw the web from a starting position which is adjacent to the banding station, arranging it along a second, closed path inside which the banding station is defined, and returning the end of the web to the starting position, so that the end of the web is opposite a section of web extending in an outfeed section of the first feed path; recovering the web using second gripper means, the latter being located upstream of the outfeed section of the first feed path, gripping the web and drawing it in a second direction which is opposite to the first, so that the web adheres around the group of sheets with a given tension; using first retaining means, situated upstream of a cutting zone relative to the first direction of feed, to hold the web in place, substantially preventing movement of the web; using second retaining means, situated upstream relative to the first direction of feed from where the first gripper means initially grips the web, to hold the web in a position to allow the first gripper means to grip the web to band a new group of sheets such that the web is positioned properly for proper banding of the new group of sheets; sealing the end of the web, at the starting position, to a first portion of the section of web located at the outfeed section of the first feed path; cutting the web at a cutting zone that is upstream of the sealing zone relative to the first direction of feed.

2. The method according to claim 1, wherein the drawing stage comprises a further stage for resting the web against guide means which define the second, closed path.

3. The method according to claim 1, comprising a stage for projecting the web along the outfeed section for the first path and towards the starting position, so that the end of the web is in a position in which it can be gripped by the first gripper means.

4. The method according to claim 1, comprising, relative to the recovery stage, a stage for removing the guide means.

5. The method according to claim 1, comprising, relative to the recovery stage, a stage for looping the web around the group of sheets, in such a way that the web makes contact with the sides of the group substantially simultaneously.

6. The method according to claim 1, comprising, after the recovery stage, further stages which use first retaining means for overlapping and locking a second portion of the section of web, extending along the outfeed section of the first feed path, against the end of the web held in the starting position by the first gripper means.

7. The method according to claim 1, comprising another stage for locking a third portion of the section of web extending along the outfeed section of the first feed path, using second retaining means located between the second gripper means and the first retaining means.

8. The method according to claim 1, comprising, relative to the stage for positioning the group of sheets, a stage for positioning the group in such a way that one of its faces is next to the first gripper means which grip the end of the web and substantially coplanar with said means.

9. The method according to claim 1, comprising, relative to the stage for drawing the web, a stage for moving the first gripper means, using drive means, along a third, closed feed path which is substantially circular and which contains the second feed path for the web.

10. The method according to claim 7, wherein the sealing stage is carried out by sealing means located between the first and second retaining means.

11. The method according to claim 3, wherein the recovery and projecting stages are carried out by the second gripper means.

12. A machine for banding groups of sheets in a substantially parallelepiped configuration, comprising a station for the application of at least one band which binds the group of sheets at which pick up and transfer means arrange a group of sheets; first gripper means for gripping the end of a continuous web, the latter being unwound from a reel and fed in a first direction and along a first feed path; the first gripper means being mobile so as to draw the web from a starting position which is adjacent to the banding station, arranging it along a second, closed path inside which the banding station is defined, and returning the end of the web to the starting position, so that the end of the web is opposite a section of web extending in an outfeed section of the first feed path; second gripper means, being located upstream of the outfeed section of the first feed path, which recover the web, drawing it in a second direction which is opposite to the first, so that the web adheres around the group of sheets with a given tension; first retaining means located upstream of a cutting zone relative to the first direction of feed for the web, which holds the web in place prior to sealing and cutting in order to substantially prevent slack in the web around the group of sheets; second retaining means located upstream relative to the first direction of feed from where the first gripper means initially grips the web, to hold the web in a position to allow the first gripper means to grip the web to band a new group of sheets such that the web is positioned properly for proper banding of the new group of sheets; sealing means located at the starting position adjacent to the banding station and mobile between a non-operating position and an operating position in which they seal a first portion of the section of web extending along the outfeed section of the first feed path to the end of the web; cutting means for cutting the web at the cutting zone that is upstream of the sealing zone relative to the first direction of feed for the web.

13. The machine according to claim 12, comprising means which guide the web, defining the second, closed path.

14. The machine according to claim 13, comprising actuator means for moving the guide means between an operating end position, in which they are in contact with the web and define the second closed path, and a home end position, in which they do not make contact with the web.

15. The machine according to claim 12, comprising, at the application station, first retaining means designed to overlap and lock a second portion of the section of web, extending along the outfeed section of the first feed path, against the end of the web, the latter being held in the starting position by the first gripper means.

16. The machine according to claim 15, comprising second retaining means located between the second gripper means and the first retaining means, being designed to grip and lock a third portion of the section of web extending along the outfeed section of the first feed path.

17. The machine according to claim 12, wherein the second gripper means are motor-driven and their direction of movement may be inverted, so that they can move in both directions.

18. The machine according to claim 17, wherein the second gripper means are designed to project the web along the outfeed section of the first path towards the starting position, so that the end of the web reaches the position in which it can be gripped by the first gripper means.

19. The machine according to claim 17, wherein the second gripper means comprise a pair of rollers which co-operate with one another, at least one of which is motor-driven, the rollers rotating about respective axes of rotation positioned on opposite sides of the given first path.

20. The machine according to claim 12, comprising drive means attached to the first gripper means and designed to move the latter along a third, closed feed path which is substantially circular and contains the second path.

21. The machine according to claim 20, wherein the first gripper means comprise a gripper unit comprising a first jaw fixed to the drive means and a second jaw which is opposite the first, the second jaw being moved, by first and second actuator means which co-operate with one another, between a first, non-operating position in which it is open and waiting for the end of the web mobile along the outfeed section of the first feed path to a gripping position, and an operating position in which it is closed and grips the end of the web against the first jaw, being held closed by the second actuator means connected to the drive means.

22. The machine according to claim 21, wherein the second jaw comprises a lever with three arms pivoting about a first axis of oscillation, the first arm supporting the second jaw, the second arm being designed so that it is intercepted by the first actuator means and the third arm being connected to the second actuator means.

23. The machine according to claim 21, wherein the first jaw comprises a contact surface with a first face which is facing the second jaw and a second face, opposite the first, which is a reference for the pick up and transfer means for a group of sheets, in such a way that the means can pick up and transfer the group of sheets with at least one of its faces next to and substantially coplanar with the second face of the contact surface.

24. The machine according to claim 20, wherein the drive means for the first gripper means comprise a support and drive device comprising a ring-shaped element which extends along the third feed path and is supported by sliding support means, the ring-shaped element comprising a ring gear connected to a pinion in the drive means and designed to cause the ring-shaped element to rotate about an axis which is substantially perpendicular to the plane on which the third feed path lies.

25. The machine according to the foregoing claims 15 or 21, wherein the first retaining means co-operate with the first gripper means and comprise a two-armed lever pivoting about a second axis of oscillation, the first arm being connected to actuator means and the second arm being mobile between a first, non-operating position in which it is distanced from the first jaw of the first gripper means and a second, operating position, in which its free end intercepts the first portion of the section of the web and overlaps it, locking it against the end of the web, in contact with the first jaw of the first gripper means.

26. The machine according to claim 16, wherein the second retaining means comprise a guide for the web which exits the second gripper means, comprising a sliding surface which co-operates with a fixed roller located on the opposite side to the surface relative to the outfeed section of the first feed path; said guide being mobile between two end positions, one allowing the web to pass freely, and the other bringing the surface into contact with the fixed roller, thus gripping and locking the second portion of the section of web extending along the outfeed section of the first feed path.

* * * * *